US011656040B2

(12) United States Patent
Horst et al.

(10) Patent No.: US 11,656,040 B2
(45) Date of Patent: May 23, 2023

(54) BOLT STOP WITH A LOCKING DEVICE FOR AN AUTOMATIC FIREARM, AND A GRIP STOCK AND RECEIVER EQUIPPED THEREWITH

(71) Applicant: HECKLER & KOCH GmbH, Oberndorf (DE)

(72) Inventors: Dennis Horst, Dornhan-Weiden (DE); Johannes Kopf, Dunningen (DE); Michael Völkle, Oberndorf/N (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 16/504,030

(22) Filed: Jul. 5, 2019

(65) Prior Publication Data

US 2020/0096267 A1 Mar. 26, 2020

(30) Foreign Application Priority Data

Jul. 5, 2018 (DE) ..... 10 2018 005 354.8

(51) Int. Cl.
*F41A 3/42* (2006.01)
*F41A 3/44* (2006.01)
*F41A 17/42* (2006.01)

(52) U.S. Cl.
CPC ..... *F41A 3/42* (2013.01); *F41A 3/44* (2013.01); *F41A 17/42* (2013.01)

(58) Field of Classification Search
CPC ..... F41A 17/36; F41A 17/40; F41A 17/42
USPC ..... 89/19
See application file for complete search history.

(56) References Cited

U.S. PATENT DOCUMENTS 4,977,814 A * 12/1990 Beretta ..... F41A 3/72 89/1.4
5,913,261 A * 6/1999 Guhring ..... F41A 3/64 89/128
7,395,747 B2 * 7/2008 Murello ..... F41A 17/40 42/70.01
8,015,742 B2 * 9/2011 Zedrosser ..... F41A 17/38 42/70.04

(Continued)

FOREIGN PATENT DOCUMENTS

DE 1890933 1/1964
DE 2523716 12/1976

(Continued)

OTHER PUBLICATIONS

German Patent and Trademark Office, "Office Action," issued in connection with German Patent Application No. 10 2018 005 354.8, dated Apr. 3, 2019, 9 pages (Machine Translation Included).

*Primary Examiner* — Joshua E Freeman
*Assistant Examiner* — Benjamin S Gomberg
(74) *Attorney, Agent, or Firm* — Hanley, Flight & Zimmerman, LLC

(57) ABSTRACT

The invention relates to a bolt stop for an automatic firearm comprising a bolt stop lever that can be moved between a release position and a catch position, and a locking device that can be moved between a standby position and a locking position, for selectively securing the bolt stop lever in the release position, wherein the locking device is disengaged with the bolt stop lever when in the standby position, and is engaged in with the bolt stop lever when in the locking position, the bolt stop lever deactivated in the locking position.

18 Claims, 10 Drawing Sheets

(56) References Cited

U.S. PATENT DOCUMENTS

| | | | | |
|---|---|---|---|---|
| 9,557,125 | B2 * | 1/2017 | Stewart | F41A 35/06 |
| 9,810,493 | B2 | 11/2017 | Fluhr et al. | |

FOREIGN PATENT DOCUMENTS

| | | |
|---|---|---|
| DE | 3035796 | 5/1982 |
| DE | 19655169 | 1/2003 |
| DE | 102012019422 | 4/2014 |
| DE | 102018005354 | 12/2019 |
| EP | 2045562 | 4/2009 |
| GB | 191115783 | 9/1911 |
| WO | 2005047804 | 5/2005 |

* cited by examiner

BOLT STOP WITH A LOCKING DEVICE FOR AN AUTOMATIC FIREARM, AND A GRIP STOCK AND RECEIVER EQUIPPED THEREWITH

RELATED APPLICATION

This patent claims priority to German Patent Application No. 102018005354.8, which was filed on Jul. 5, 2018. German Patent Application No. 102018005354.8 is hereby incorporated herein by reference in its entirety.

FIELD OF THE DISCLOSURE

The invention relates to a bolt stop with a locking device for an automatic firearm and a grip stock and receiver equipped with such a bolt stop with a locking device.

BACKGROUND

Position terms in this document, such as "up," "down," "front," and "back," etc. always refer to a firearm held in a normal shooting position, in which the bore axis is horizontal, and the rounds are fired toward the front, away from the shooter.

Bolt stops of different designs are known, and are used to catch and retain a bolt, or release the bolt in order to fire a round.

In many weapons such as light machine guns, machine pistols, and pistols, it has become standard practice for the bolt to be kept in the open position after firing the last cartridge. Typically, the bolt is held open with a bolt stop. For this, the cartridge carrier in the magazine normally presses against an arm of the bolt stop extending into the magazine well after the last round has been fired. The cartridge carrier pivots or bolts the bolt stop into the movement path of the bolt. This position of the bolt stop is the so-called catch and retain position. The bolt, which first returns after firing a round, travels over the bolt stop toward the rear of the firearm and then strikes the bolt stop when the bolt moves forward again, so that the bolt stop blocks the bolt from closing.

After a full magazine has been inserted, the shooter can release the bolt by manually actuating the bolt stop or a bolt stop lever on the bolt. In this position, the bolt stop lever ends up in a so-called release position again. The bolt then moves forward when the bolt stop is released and loads a cartridge into the chamber as the bolt continues to move forward, and the weapon is again ready to fire.

This automatic catching and retaining of the bolt as it moves forward when the magazine is empty has two advantages. In particular: the shooter can immediately see when the magazine is empty, and he can chamber a round by releasing the bolt after a full magazine has been inserted, without having to rack the bolt.

A bolt stop is known from DE 10 2012 019 422 B3 by the same applicant, which has an bolt stop lever, and which has operating handles protruding on both sides of the weapon for ambidextrous operation.

An automatic pistol with a magazine retainer and a bolt stop is known from DE 30 35 796 C2. The bolt stop is connected to the magazine retainer via a spring handle mechanism, wherein the magazine retainer and the bolt mechanism are functionally connected to one another such that when the magazine retainer is actuated, the bolt can be released from s retained position. The bolt stop can be displaced longitudinally.

A bolt stop is known from DE 25 23 716, which is coupled to a release device that has a releasing lever, for releasing the firing mechanism. The bolt stop can also be actuated via this releasing lever.

An automatic firearm w with a bolt stop in the form of a multi-arm lever is also known from DE 1 890 933 by the same applicant. A pivotable control piece is located behind the lower end of a front arm of the catching lever in a release position. After the last round has been fired, a cam on a lower surface of the feeder strikes the control piece to release the catch lever, and a rear arm of the catch lever extends into the movement path of the bolt.

GB 15 783 describes a bolt stop with a catch that can pivot about an axis, wherein the catch comprises two walls that each have a catch projection. Deactivation of the bolt stop as such is not intended. A multifunctional safety/bolt stop release lever is used to disengage the bolt stop from the bolt when the feeder in the empty magazine does not strike the stop with an actuator lug and pivots the actuator lug upward into the movement path of the bolt, as is the case with each cartridge located therein when the magazine is loaded.

WO 2005/047804 A2 discloses a bolt stop and release mechanism for an automatic firearm, which can be brought into the bolt catching position after firing the last round via the feeder in the magazine. The bolt stop comprises a lever end that extends downward in the region of the trigger guard, which a shooter can push manually downward in order to bring the bolt stop into its release position.

The bolt stop/release mechanism has the same bolt stop blocking system that is described in DE 196 55 169 C2 by the applicant.

In some situations a detrimental effect may arise when the bolt is blocked by a bolt stop in an activated state, also called the bolt catch and retain position, after the last round has been fired, and thus is held open in its rear position. In the example activated state or bolt catch and retain position, the bolt is not blocked by the bolt stop. Because the bolt is held open, an ejection window through which the fired cartridge is ejected is also normally open to the environment. The ejection window is normally located in front of the bolt in the direction of firing when the bolt is in the retained position, and for this reason is open. When the bolt stop is not activated (e.g., the bolt is in the release position), the bolt is normally in its forward position, thus closing the ejection window.

When the bolt stop is activated, the ejection window of the weapon remains in the open state after firing the last round until a new magazine has been inserted and/or the bolt stop has been manually actuated in order to release the bolt such that it can move forward, toward the chamber.

Disadvantageously, contaminants such as sand or sludge can enter the interior of the receiver and its components under adverse conditions, e.g. due to sand swirling around in desert regions, which can lead to a malfunctioning of the weapon.

Previously, such a bolt stop may have been eliminated entirely for this reason, such that the weapon could be used under all conditions, thus increasing the reliability of the firearm.

Lastly, the aforementioned DE 196 55 169 C2 by the same applicant discloses an automatic firearm in this regard that has a bolt stop and a locking mechanism. The locking mechanism is intended to secure the bolt stop in its standby position, and is designed as a trigger spring. A forward leg of the spring passes through the bolt stop and engages behind a projection in the grip stock. There are two recesses for receiving the spring leg on either side of the bolt stop.

When the forward spring leg is placed in the one recess, the bolt stop can be moved from the bolt releasing position to its bolt catching position. When the spring leg is placed in the other recess, the bolt stop is unable to move upward into its bolt catching position, and it is secured in the bolt releasing position. The forward spring leg is in permanent engagement with the bolt stop at this point.

BRIEF DESCRIPTION OF THE DRAWINGS

Example embodiments of the invention are explained in greater detail below in reference to the attached, schematic drawings.

DETAILED DESCRIPTION

Figure 1:
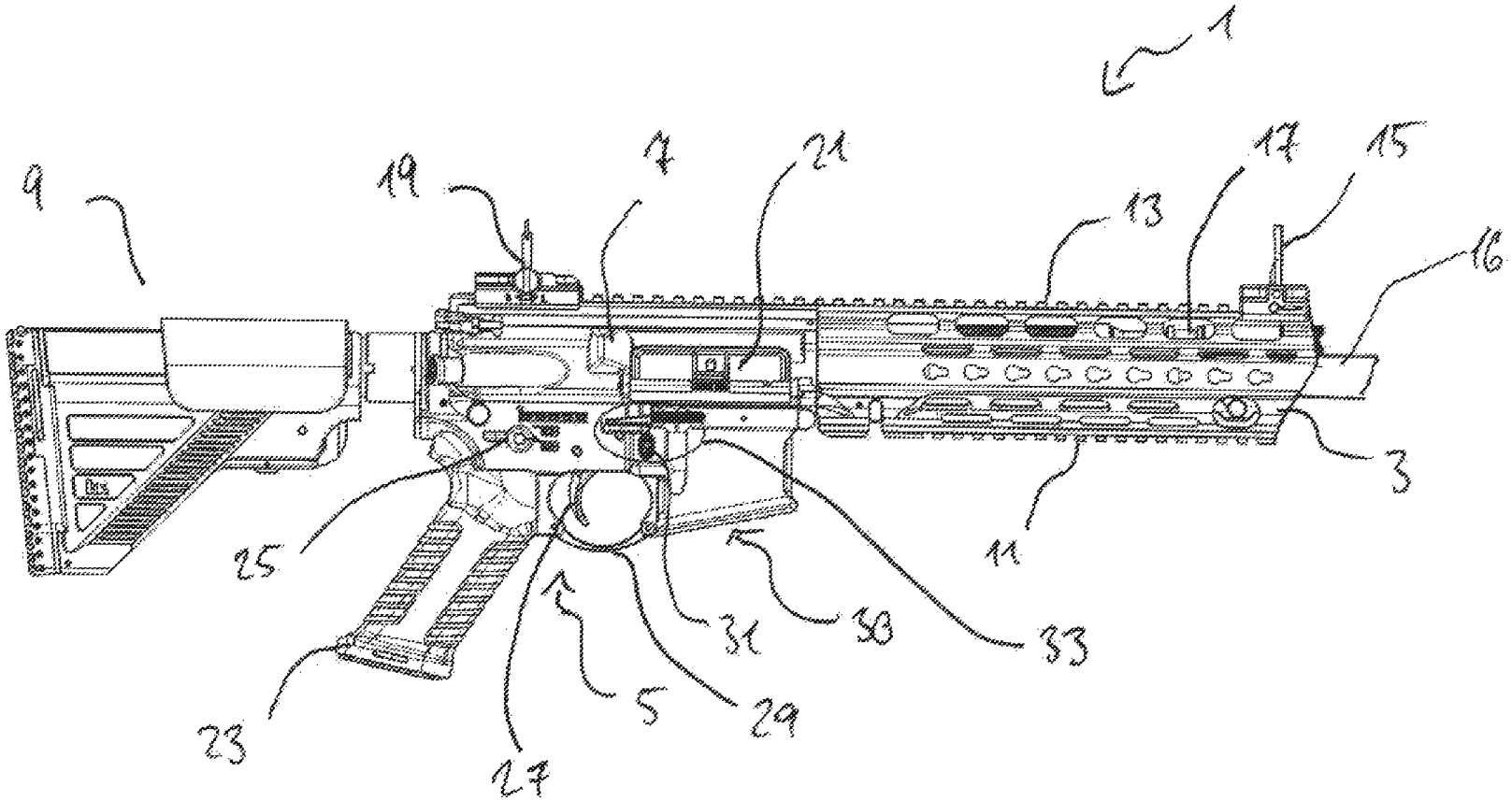
FIG. 1 shows an automatic firearm with an example of a bolt stop and disclosed locking device, in a side view from the right.

FIG. 1 shows an automatic firearm 1 in the form of an assault rifle, specifically the HK416 by the applicant. The automatic firearm 1 includes a receiver, composed of a hand guard 3, a lower grip stock 5 and an upper receiver part 7. There is a butt 9 at a rear end, toward the left in FIG. 1. The assembly and disassembly of these elements takes place in a known manner.

The hand guard 3 includes a lower Picatinny rail 11 on a lower surface and an upper Picatinny rail 13 on an upper surface. There is a flip-up front sight 15 at a front end of the hand guard 3. The hand guard 3 encompasses a barrel (not shown) in its interior, and a gas-operated reloading mechanism 17.

The upper receiver part 7 comprises a flip-up rear sight 19 at a rear end of the upper receiver facing the butt 9, which is secured on the upper Picatinny rail 13 in a known manner. There is a bolt assembly in the interior that is not shown, which is composed of a bolt carrier with a bolt carrier head (not shown), and is used for feeding, extracting and reloading cartridges in a known manner. There is a cartridge ejector 21 in a front section of the upper receiver part 7, which is coaxial to the barrel (not shown), and is provided in a known manner behind a chamber (not shown) and above a magazine well 30 in the grip stock 5.

The grip stock 5 includes a handle 23, and a firing selection lever 25, which is used in a known manner to switch between single firing and continuous firing modes, etc. Furthermore, there is a trigger 27 located within a trigger guard 29. There is an operating handle 31 for actuating a magazine retaining/releasing mechanism located above the trigger guard 29 in the form of a release button, with which a magazine (not shown) that has been inserted in the magazine well 30 is retained therein, and/or can be released therefrom. A circled section 33 is provided above the operating handle 31, which is enlarged in a detailed illustration in FIG. 2, and shows the components of a bolt stop 36 and a locking device 42 (cf. FIGS. 2 to 7).

The functioning of a bolt stop 36 has already been explained in the introduction. The bolt stop 36 comprises an integral bolt stop lever 39 according to DE 10 2012 019 422 B3 by the same applicant, cited in the introduction.

Figure 2:
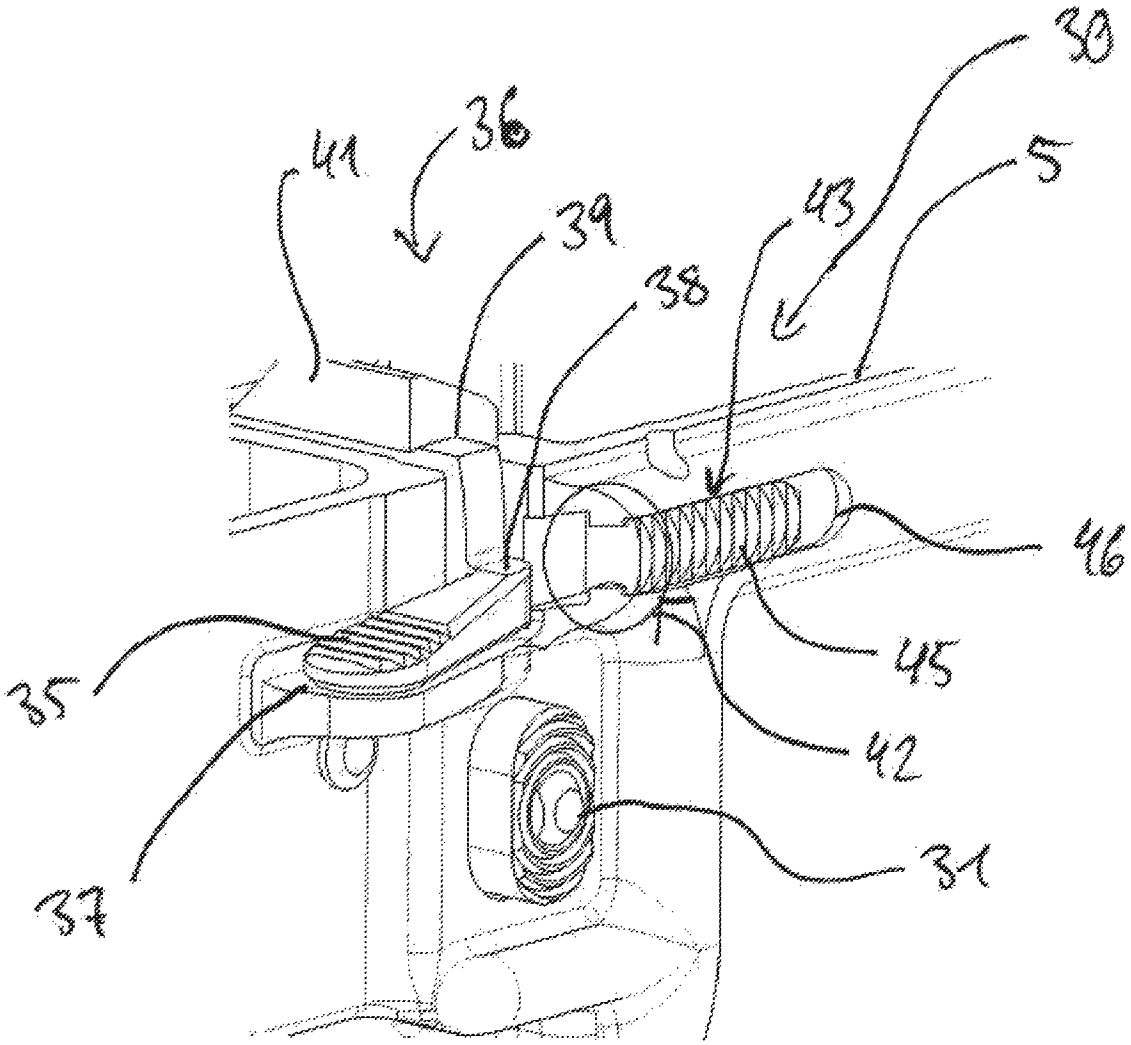
FIG. 2 shows an enlarged perspective detailed illustration of the bolt stop with a locking device from FIG. 1, in a diagonal view from the back.

FIG. 2 shows an enlarged perspective illustration of the circled section 33 in FIG. 1. A portion of the rear end of the magazine well 30 is shown in the upper right-hand region. An actuating handle 35 for operating the bolt stop 36, specifically the integral bolt stop lever 39, is shown in the middle. The actuating handle 35 bears on a bearing surface 37 formed on the right-hand side of the grip stock 5, and bolt stop lever 39 is in its release position, in which the bolt can bolt over the bolt stop lever 39.

The bolt stop lever 39 comprises a bolt catching and retaining surface 41 on its upper surface, which functions like that described in DE 10 2012 019 422 B3 by the same applicant. After firing the final round in the magazine, a magazine feeder pushes the bolt stop 39 upward into a catching position.

The operating handle 31 for a magazine retaining/releasing mechanism is illustrated in an enlargement. The magazine retaining/releasing mechanism is pushed into the grip stock 5 against the force of a spring (not shown), by means of which a lug (not shown) is disengaged from a recess formed in the magazine (not shown), such that the magazine falls downward, out of the magazine well, or can be removed therefrom.

FIG. 2 also shows a portion of the safety mechanism or locking device 42 lying opposite the actuating handle 35, with a partially cut away, grooved locking element 43 on an operating surface 45. The operating surface 45 of the locking element 43 has is on an outer surface. The locking element 43 is inserted laterally, coaxial to the barrel 16, into a guide recess 46 on the right-hand side of the grip stock 5, at the upper end of the magazine well 30. The locking element 43 is guided longitudinally within the guide section 46.

In order to actuate the locking element 43, the operating surface 45 has a grooved structure on the outer surface to make it easier to grip. This also enables an actuation under adverse conditions, or while wearing gloves, for example.

Figure 4:
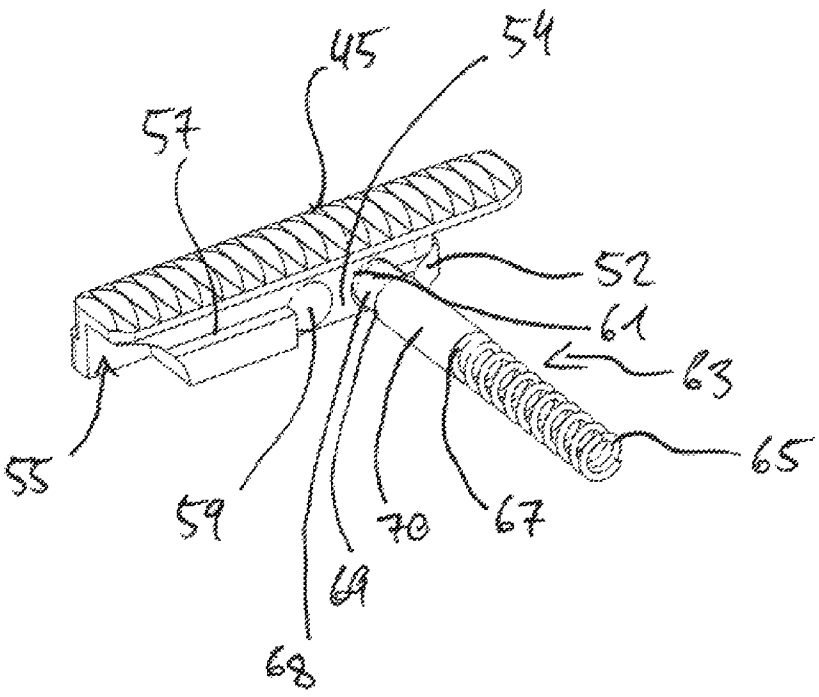
FIG. 4 shows a perspective detailed illustration of an example of the safety device in FIG. 2, in a diagonal view from below and behind.
Figure 3:
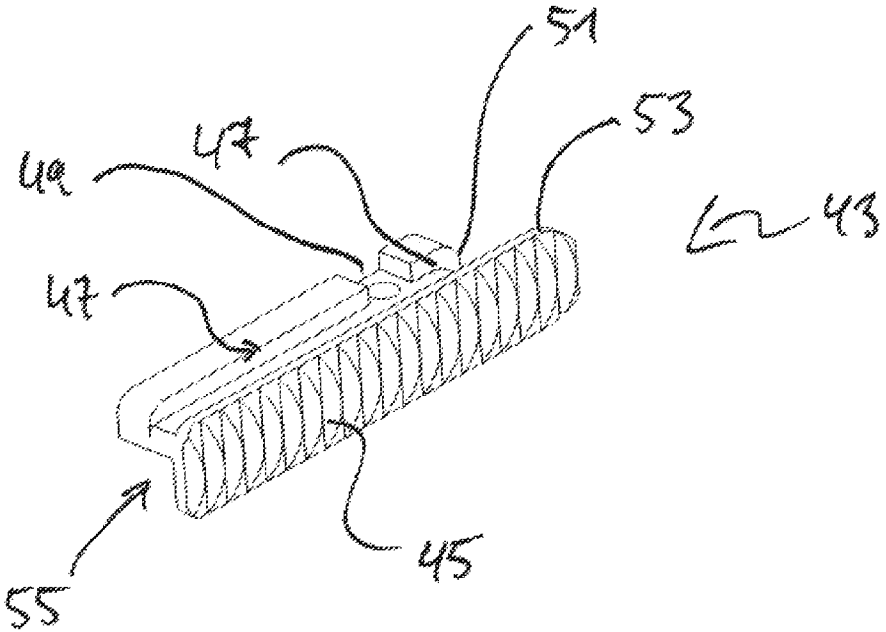
FIG. 3 shows a perspective detailed illustration of an example of the safety device in FIG. 2, in a diagonal view from above and behind.

FIG. 3 shows an enlarged detailed, diagonal view of the locking element 43 from the rear and above, and FIG. 4 shows an enlarged detailed illustration of the locking element 43 in a diagonal view from the rear and below.

The locking element 43 or the safety bolt 43 can be slid between a release position and a locking position, wherein the bolt stop 36 is allowed to function when in the release position, and deactivates the functioning of the bolt stop 36 when in the locking position.

The operating surface 45 is basically rectangular, and there are guide segments 47 for guiding the locking element 43 in the grip stock 5 on a back surface thereof, and, thus, the side facing the grip stock 5, and placed therein. Guide segments 47 are formed as grooves extending over the upper surface of the locking element 43, and are interrupted at the appropriate point (cf. FIG. 5 as well in this regard).

Furthermore, there is a through hole 77 in the form of an extension of a retaining deactivation recess 61, which passes through the locking element 43 transverse to the direction of firing. An upper recess 49 between the guide segments, that has the through hole 77, is used for removing the locking element 43 from the grip stock 5.

In order to remove the locking element 43, a pin (not shown) inserted through the through hole 77 and a retaining pin 63 is pushed inward against a retaining spiral spring 64 in the grip stock 5 until an annular segment 68 is far enough in the grip stock 5 that the annular segment 68 is no longer behind an edge segment 52 and the locking element 43 can be removed toward the back from the guide 46 in the grip stock 5. For this, the bolt stop 36 must first be removed from the grip stock 5.

In order to assemble the locking element 43 in the grip stock 45, the locking element 43 is pushed into the guide segment 46 of the grip stock 5, where the locking element 43 passes over a beveled side of the edge segment 52 of the annular segment 68 of the retaining pin 63, which latches into a recess 54 in one of the retaining recesses 59 or 61.

The guide segment 47 runs circumferentially downward at a right-hand, front, rounded end 51 of the locking element 43. The guide groove, or guide segment 47, is interrupted at the lower surface of the locking element 43 where it borders on the edge section 52. The rear retaining recess 59 and the forward retaining recess 61 are provided in the recess 54. A guide recess or another guide segment 57 is adjacent to the recess 54, and extends toward a rear end of the locking element 43. The guide segment 57 does not continue to the rear end of the locking element 43, but ends instead slightly before the end, in order to leave sufficient space for a locking surface 55 that receives or encompasses the front end of the actuating handle 35 of the bolt stop lever 39.

Figure 5:
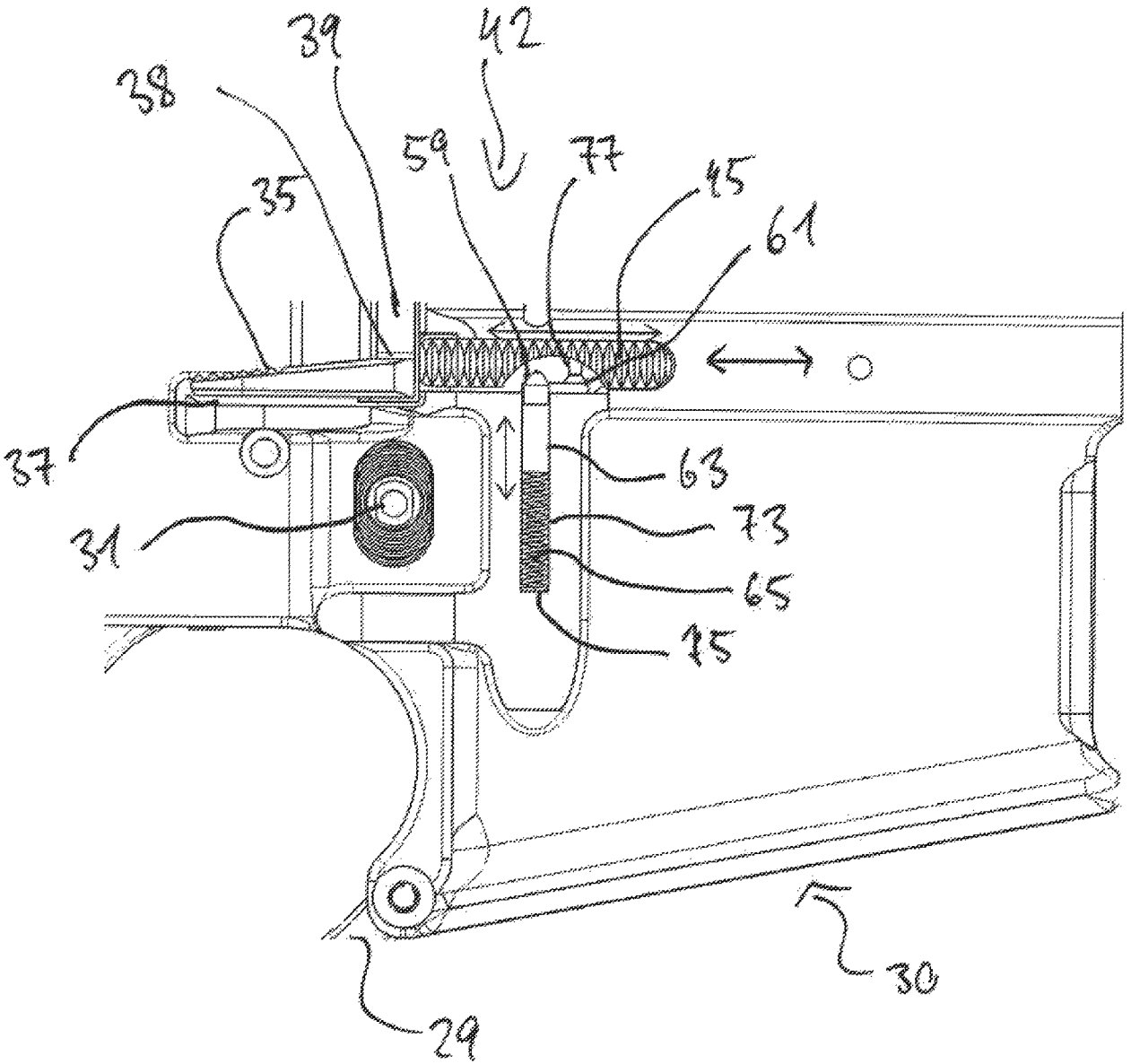
FIG. 5 shows a partially cutaway detailed illustration of the bolt stop with a safety device according to the examples shown in FIGS. 1 to 4, in a side view, with an activated bolt stop.
Figure 6:
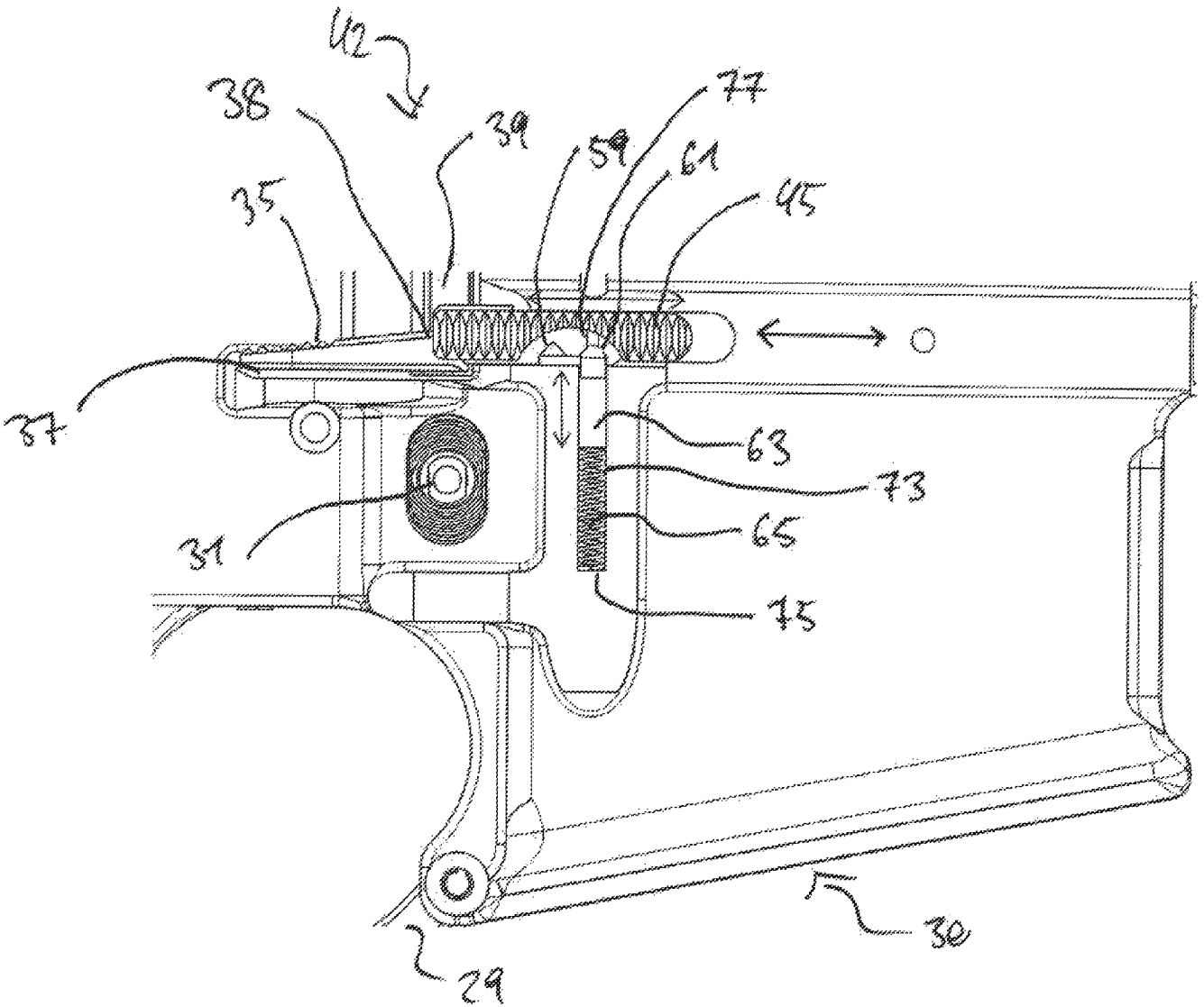
FIG. 6 shows the bolt stop with an example safety device from FIG. 5, when the bolt stop is deactivated.

The manner in which the actuating handle 35 of the bolt stop lever 39 is secured shall be described below in reference to FIGS. 5 to 7.

The locking element 43 extends at an extended protruding end 53 beyond the guide surfaces 47, 52, overlapping these surfaces, and thus forming a bearing surface on the grip stock 5 with its rear surface.

As can be seen in FIG. 4, there is a retaining pin 63 on the lower surface of the locking element 43, the upper end of which (cf. FIGS. 5 to 7) has a conical end section 68, the dimensions of which are basically complementary to the dimensions of the retaining recesses 59 and 61, and the diameter of which is smaller than an annular segment 70. These two complementary conical surfaces delimit the insertion depth of the retaining pin 63 in the respective recesses 59 or 61. The retaining pin 63 has a slightly tapered annular segment 68 adjacent to the conical end segment, which transitions at a step 69 to an oblong annular segment 70 with a larger diameter.

The annular segment 70 tapers at its lower end and forms a pin segment there, via which a counter-bearing 67 in the form of a stop for a retaining spring 64 is formed.

As shall be explained below in reference to FIGS. 5 to 7, the rear retaining recess 59 serves to activate or release the bolt stop 36 and the forward retaining recess 61 serves to deactivate the functioning of the bolt stop 36 when in the assembled state.

The locking element 43 is supported such that it can be displaced longitudinally in the guide segment 46 of the grip stock 5. This displacement is indicated schematically by the arrow in FIGS. 5 to 7. In FIG. 5, the retaining pin 63 is retained at its conical end in the rear retaining recess 59. The retaining pin 63 is inserted in a spring-loaded manner into a blind hole 73 that is perpendicular to the direction of firing. A retaining spring 65 is delimited and tensioned at its lower end by a counter-bearing 75 at the bottom of the blind hole 73.

The retaining pin 63 can be moved downward toward the counter-bearing 75, counter to the force of the spring 65 in the blind hole 73, in order to release it. In FIG. 5, the retaining pin is located in the rear retaining recess 59, in which the bolt stop 36, and in particular the actuating handle 35 of the bolt stop lever 39, are released. In this state, the bolt stop lever 39 can perform its function and catch the bolt after the last round has been fired.

By actuating or displacing the locking element 43 to the left, thus toward the stock or butt 9 of the automatic firearm 1, the lower surface of the locking element 43, specifically the complementary conical surfaces of the retaining recess 59 and the upper end of the retaining pin 63, forces the retaining pin 63 downward, counter to the spring force of the spiral spring 65, such that the locking element 43 can be moved further backward. In doing so, the conical end of the retaining pin 63 bolts from the rear retaining recess 59 to the forward retaining recess 61, and enters this recess, as shown in FIGS. 6 and 7. In FIGS. 5 to 7, the rear section of the operating surface 45 is partially cut away, in order to illustrate this procedure.

When the retaining pin 63 enters the forward retaining recess 61, the retaining spiral spring 65 is at least partially untensioned, and secures the retaining pin 63 in the forward retaining recess 61. In this position, the bolt stop 36 is deactivated, because the rear end of the locking element 43 is pushed over the complementary counter-surface 38 (cf. FIGS. 6, 7) on the actuating handle 35 of the bolt stop lever 39 at the locking surface 55 that basically forms a right angle. As a result, the bolt stop lever 39 is secured in its release position, such that the retaining or guide surface 41 cannot extend upward into the movement path of the bolt, or bolt head (not shown), and the bolt cannot be caught or retained.

Figure 7:
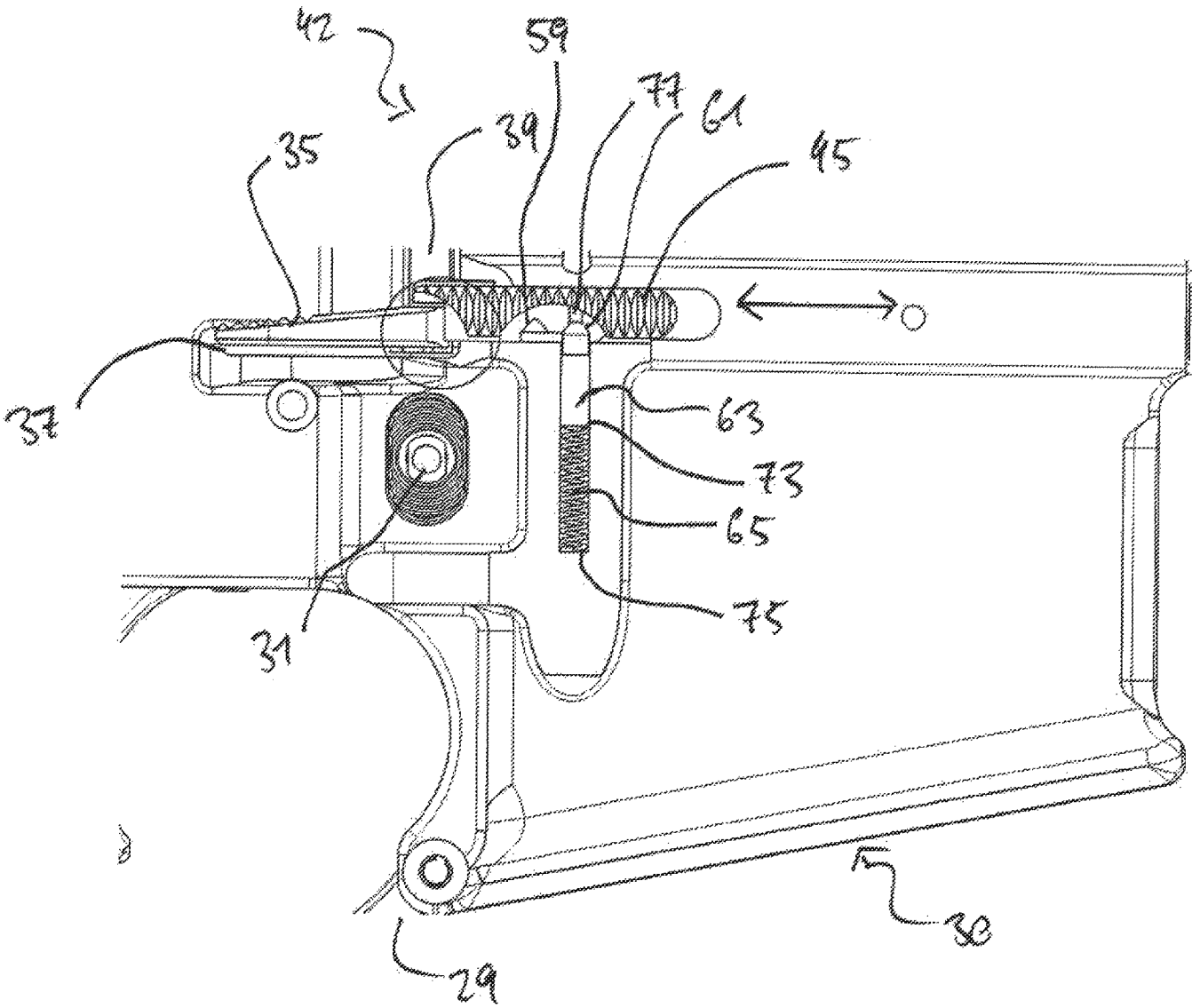
FIG. 7 shows the bolt stop with an example safety device from FIG. 6, with a further subsection.
Figure 8:
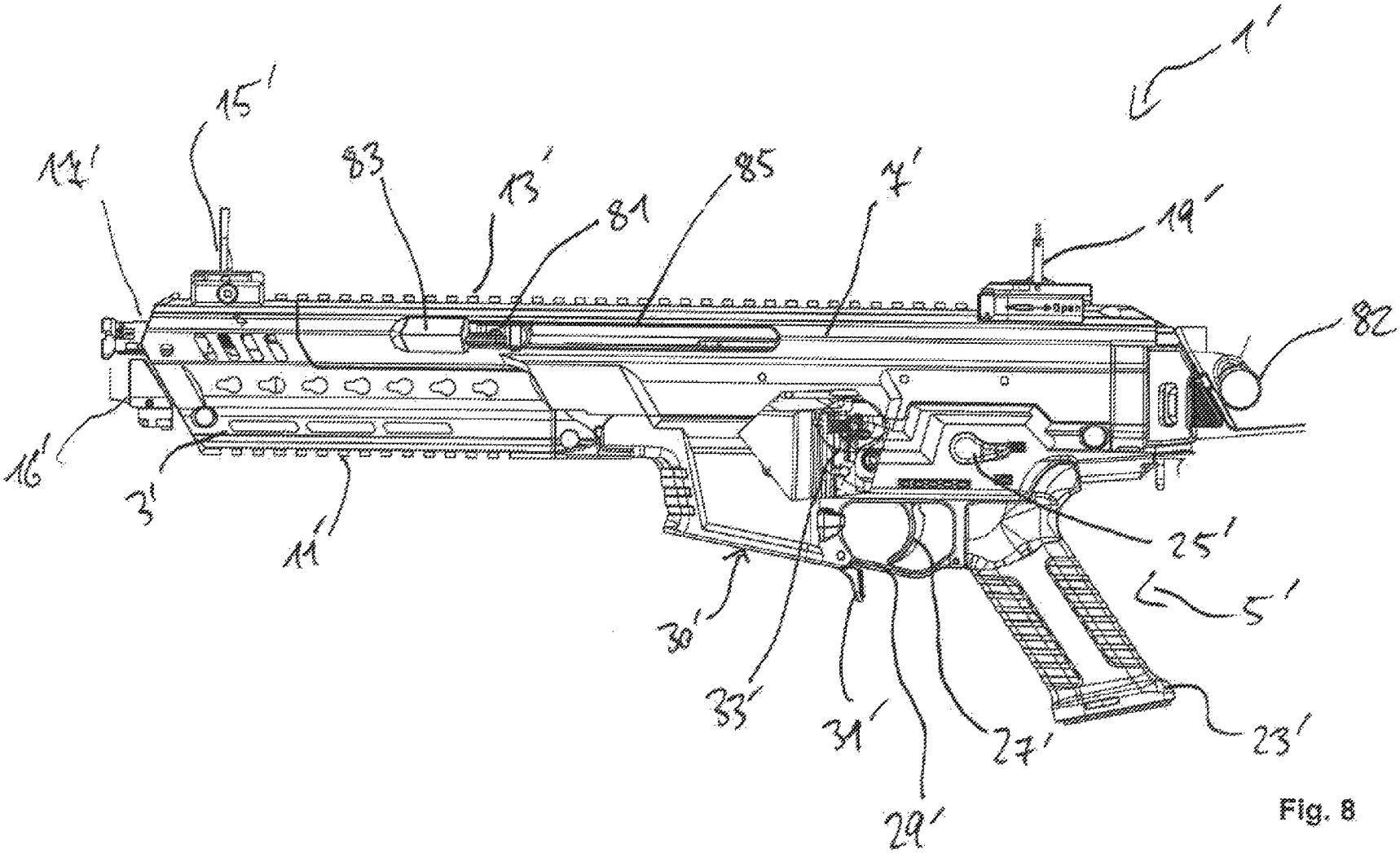
FIG. 8 shows an automatic firearm with a second example bolt stop with a locking device according to the invention, in a side view from the left, with a subsection.

In FIG. 7, this rear end, or the locking surface 55, is partially cut away inside the circle, and show how the locking surface 55 bears on the counter-surface 38 of the actuating handle 35. The guidance of the locking element 43 in the grip stop guide within the guide segment 46 is likewise illustrated.

In order to activate or release the bolt stop 36, the procedure is reversed, i.e., the shooter bolts the locking element 43 at its operating surface 45 to the right, thus toward the muzzle, by means of which the retaining pin 63 is pushed downward, counter to the spring force of the retaining spiral spring 65, via which the conical end surface is forced out of the forward retaining recess 61, until it can re-enter the rear retaining recess 59, and secure the locking element 43 or the safety bolt 43 in the release position.

FIGS. 8 to 12 show a second embodiment of the automatic firearm 1, which in the present case is in the form of the assault rifle HK433 by the applicant.

The assault rifle 1 has elements corresponding to the first embodiment, which deviate in part therefrom in terms of their shape and design. There is no butt here, but instead only an interface 82 where a butt can be attached. Furthermore, the embodiment according to FIGS. 8 to 12, and in particular FIG. 8, differs from the first embodiment according to FIGS. 1 to 7 in that a racking mechanism 81 with a racking lever 83 is shown as the actuating handle, which is located inside a guide slot 85 in the receiver, specifically an upper receiver part 7', in order to rack the bolt, or gas-operated loading mechanism, in the known manner.

The reference symbol 33' indicates a section of the bolt stop with a locking mechanism or locking device 42'. In differing from the locking device 42 in the first embodiment, which is inserted into the receiver wall in the grip stock 5, the locking device 42' in the second embodiment is located in the interior of the receiver, specifically opposite a trigger mechanism 86 on the rear end of a magazine well 30' in a grip stock 5'.

FIGS. 9 to 12 show the section 33' in an enlarged sectional view, or the locking device 42' with a locking element 93, in two perspective illustrations.

Figure 9:
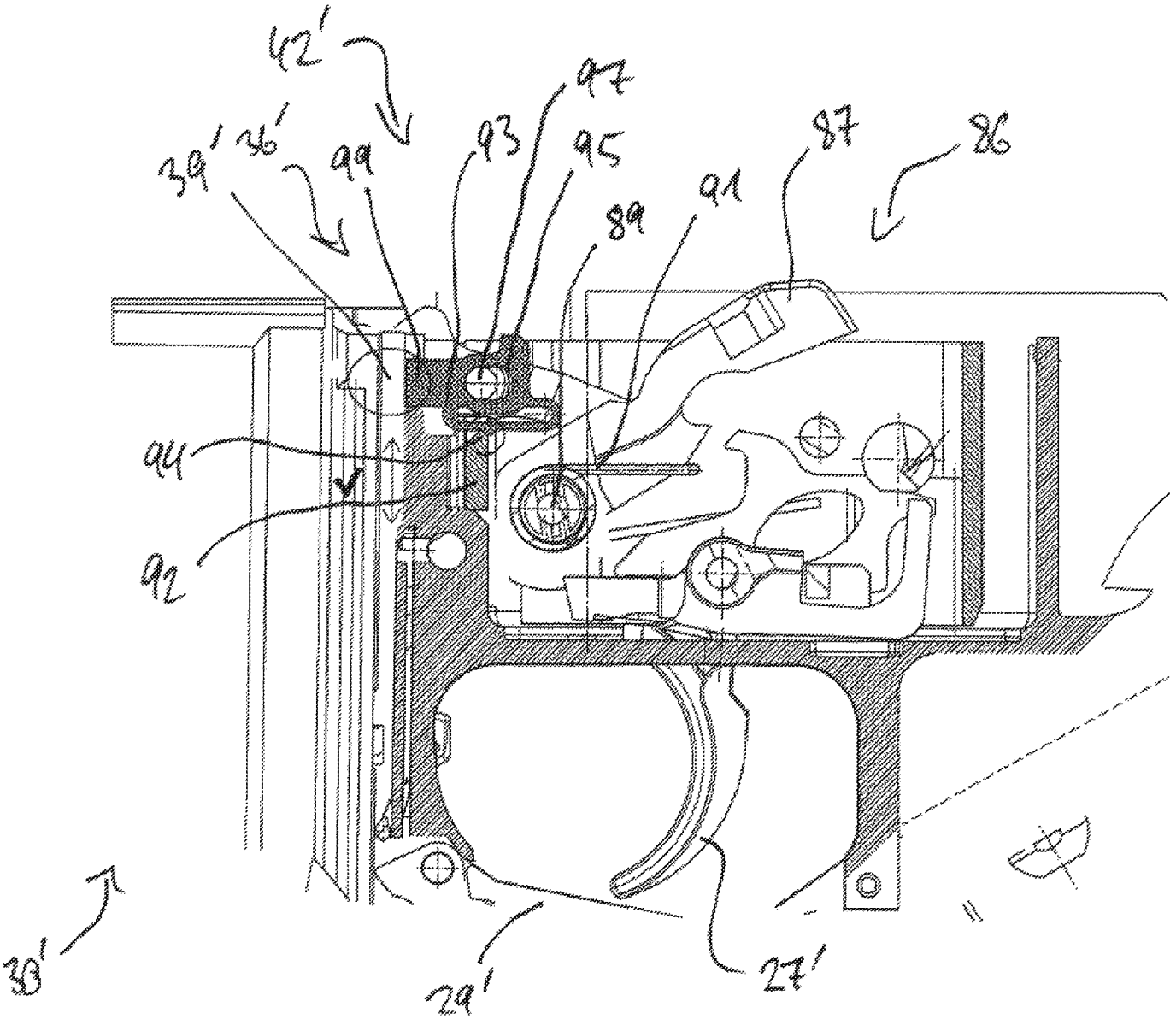
FIG. 9 shows the example of the bolt stop with a locking device according to FIG. 8 in a partially cutaway side view, when the bolt stop is activated.
Figure 11:
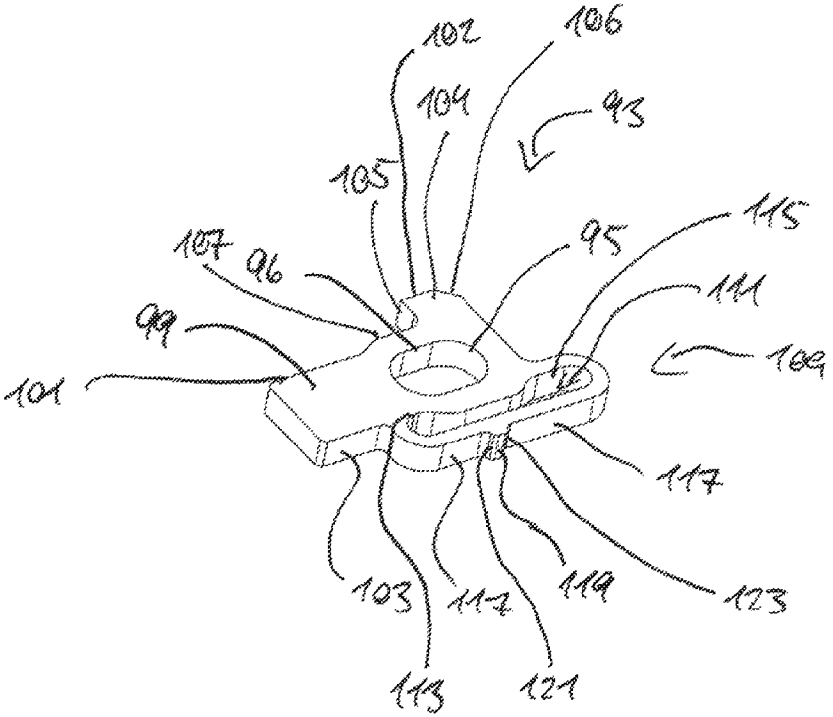
FIG. 11 shows a perspective side view of the locking element from FIG. 10 in a diagonal view from the front and below.
Figure 10:
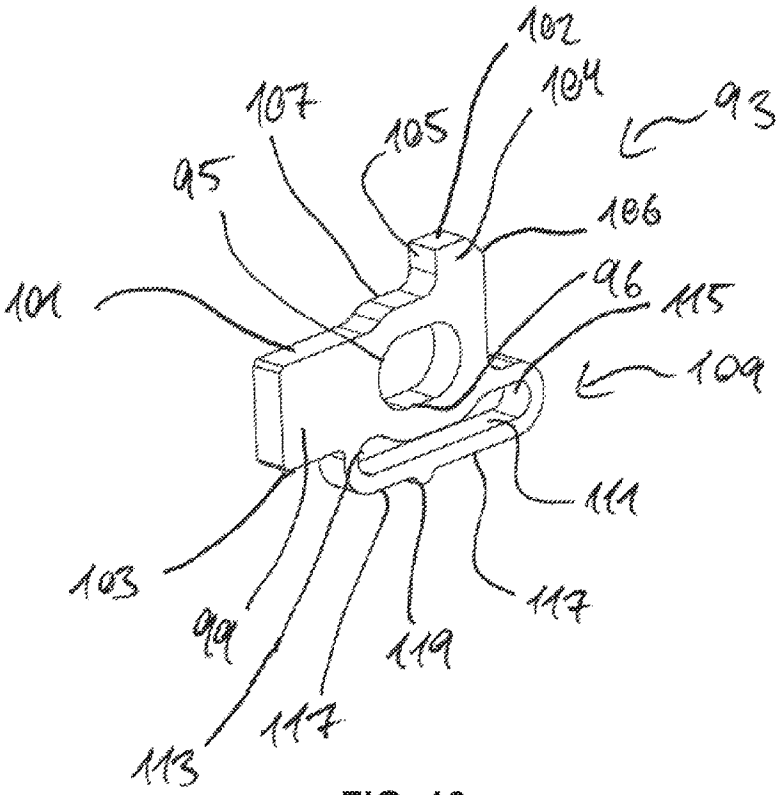
FIG. 10 shows a perspective view of a locking element of the safety device according to the example shown in FIG. 9, in a diagonal side view from the front.

FIG. 9 shows a longitudinal sectional view cut through the assault rifle HK433 somewhat to the left of a trigger 27'. The trigger mechanism 86 is shown in greater detail in the grip stock 5', and comprises a known hammer 87, which is supported on a hammer axle 89, and is tensioned against a force of a hammer spring 91 in FIG. 9. The other actuating elements for releasing the trigger mechanism after actuating the trigger 27' are known and thus shall not be explained further.

The locking device 42' is shown at a front end, thus an end of the receiving space for the trigger mechanism 86 facing the magazine well 30'. This substantially comprises a so-called form spring 93 (cf. FIGS. 10 and 11). This has an oblong hole 95, which is supported on a form spring bearing axle or securing axle 97 that passes through the grip stock 5 transverse to the direction of firing, such that it can be displaced longitudinally in the direction of firing or counter to the direction of firing. The form spring 93 interacts at its lower surface with a pin-like counter-retaining element 92, which extends upward in the lower receiver part 5', perpendicular to the direction of firing in relation to the bore axis of the automatic firearm 1 (not shown). The counter-retaining element 92 has a wedge-shaped end section 94 at its upper end, which in turn engages with the form spring 93 (cf. FIGS. 9 and 12).

The form spring 93 forms a locking element, and has guide surfaces 96 on an upper surface and an opposing lower surface, basically in the middle of the oblong hole 95, which allow a displacement of the form spring 93 on the securing axle 96. The form spring 93 comprises a core section, which encompasses the oblong hole 95 with basically complementary dimensions. There is an extension 99 on a front surface of the form spring 93, thus at the side facing the magazine in the assembled state, which has an upper guide surface 101 on the upper surface and a lower guide surface 103 on the lower surface. The front edges are rounded, in order to facilitate insertion/guidance. The lower guide surface 103 corresponds to a locking surface, which locks the bolt stop function when the extended section 99 enters the bolt stop 36' or the bolt stop lever 39' and a complementary recess 100 with its front end, and thus secures the bolt stop 36' or the bolt stop lever 39' (cf. FIG. 12), if this is desired.

The upper guide surface 101 transitions in the shape of a wave toward the oblong hole to a raised transition segment 107, which in turn transitions to an upward extension 104. The upper extension 104 has a basically planar surface 102 at the upper surface, and has an operating surface 15 at the surface facing the extension 99, which allows the shooter to grip the upper extension 104 and actuate it manually.

In order to actuate the form spring 93, a shooter can insert a finger into the region of the trigger mechanism 86, wherein the form spring 93 is preferably located in the left-hand third of the receiving space for the trigger mechanism 86, thus at a lateral distance to the hammer 87.

There is a spring segment 109 on the lower surface of the form spring or the locking element 93. This comprises a cut out region 111 that basically extends over the entire length of the lower surface of the form spring 93 beneath the oblong hole 95. The cut out region 111 is widened at a front end 113 and a rear end 115, There is a retaining lug 119 on the lower surface of the form spring 93, which extends downward in the shape of a wedge in the front third of the lower surface, between guide segments 117. Because of the elasticity, in particular the cut out region 111, the retaining lug 119 can be pressed down in order to move the form spring 93 from the standby position to the locking position and back toward the oblong hole 95 (cf. FIG. 12).

The retaining lug 119 bears against the rear, wedge-shaped end 94 of the counter-retaining element 92 at its front surface facing the magazine well 30'. The counter-retaining element 92 is rigidly mounted inside the receiving space for the trigger mechanism 86 at its forward wall. The counter-retaining element 92 is in the form of a steel pin, which is inserted into the aluminum of the trigger receiver, in a recess.

In the position shown in FIG. 9, the bolt stop 36' or the bolt stop lever 39' is inserted in a recess in a rear magazine well wall. The bolt stop lever 39' also comprises a recess 100, the dimensions of which basically correspond to the dimensions of the extension segment 99 of the form spring 93 (cf. FIG. 12). In FIG. 9, the form spring 93 is secured in place via the counter-retaining element 92. The bolt stop lever 39' is released in terms of its functioning, as indicated by the arrows extending on both sides, perpendicular to the direction of firing. The bolt stop 36' is in the activated state, in which the bolt stop 36' can catch and secure the bolt (not shown) after firing a last round.

Figure 12:
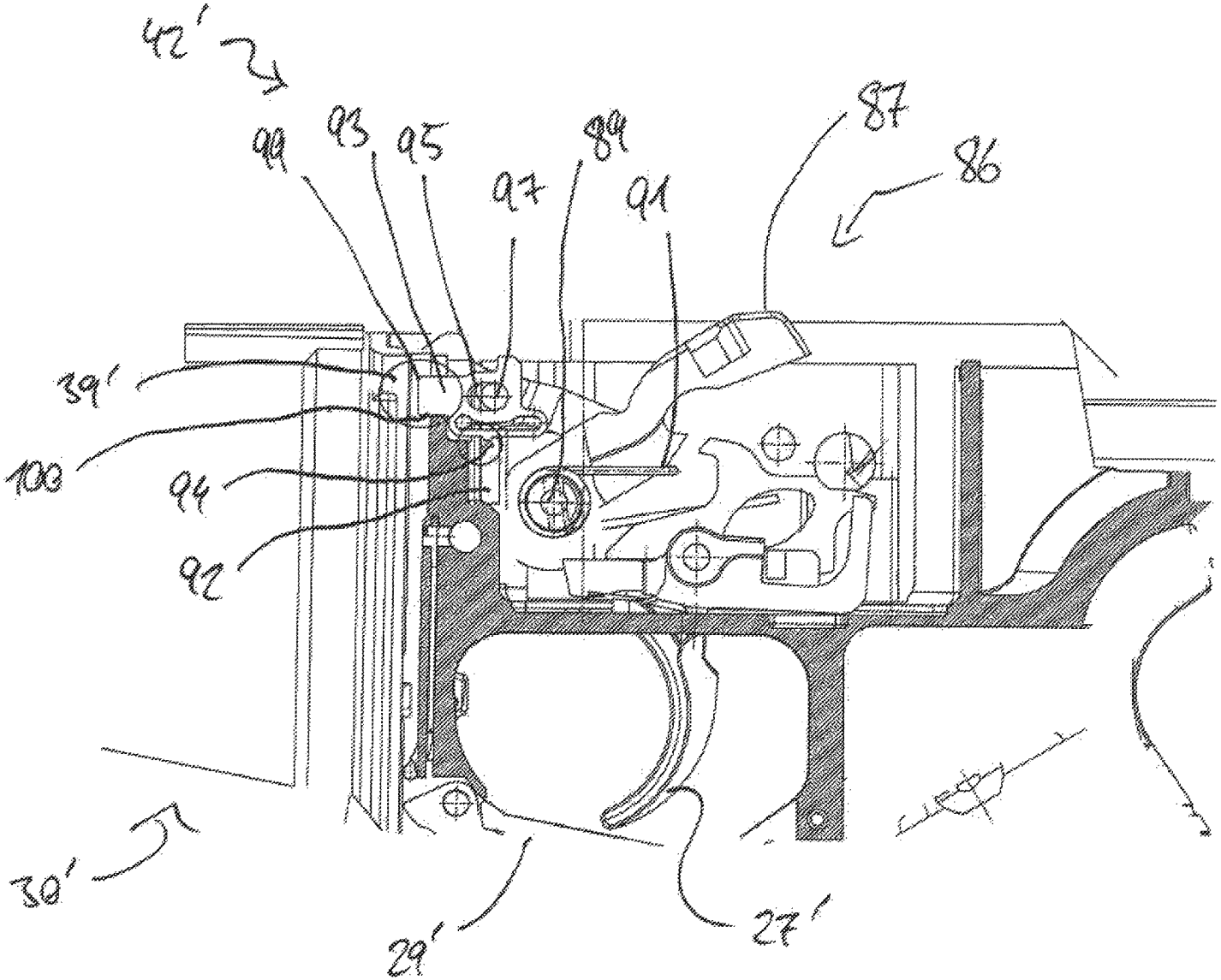
FIG. 12 shows the bolt stop from FIG. 9 in a deactivated state.

FIG. 12 shows the bolt stop 36', or the bolt stop lever 39' in the deactivated state. In differing from FIG. 9, the form spring 93 is slid forward by a shooter by gripping the extensions 104, in particular the operating surface 105, such that the rear end of the oblong hole 95 extends over the guide surfaces 96, and bears on the form spring axle 97, In this procedure, the retaining lug 119 on the lower surface of the elastic spring segment 109 is pushed upward, thus deformed or pushed into the cut out region 111, such that the retaining lug 119 bolts over the wedge-shaped end segment 94 at a front, wedge-shaped surface 121 of the counter-retaining element 92 until a rear, wedge-shaped surface 123 of the counter-retaining element 92 again bears on the front wedge segment of the wedge-shaped end 94 of the counter-retaining element 92 (cf. lower circle).

In this position, the extended segment 99 of the form spring 93, or the locking element 93, engages in the recess 100 of the bolt stop lever 39' or the bolt stop 36 (cf. upper left-hand circle). In the deactivated state, the bolt stop 36' can no longer be brought into the movement path of the bolt (not shown) after firing a last round, such that, as mentioned in the introduction, the bolt remains in its forward end position after firing the last shot, thus blocking a lateral ejection window 21', such that an entering of contaminants is prevented, or at least reduced.

The advantage of the internal fours spring 93, or locking element 93, in the second embodiment is that it is located inside the lower part of the grip stock 5', such that an unintended operation thereof is prevented. The form spring 93 can be configured, or provided with a corresponding elasticity, such that an accidental or unintentional movement of the operating element, or the operating surface 105 and the extension 104, by a user, and particularly by an acceleration of the firearm when firing rounds, is prevented.

In the first embodiment, the locking element 43 is advantageously located in the outer wall of the lower part of the grip stock 5 in the receiver, in order to thus prevent an unintended deactivation as a result of the end being flush therewith. In addition, the spring configuration, or the pressure element configuration, prevents an unintended actuation of the locking element 43, resulting from the acceleration in the firearm when firing a round, for example.

Although the invention is defined in the independent claims, further designs and aspects of the invention are defined in the framework of the subsequent claims, the description, and the drawings.

Further designs of the invention can be derived by the person skilled in the art from the following claims.

The examples disclosed herein create an alternative deactivation of the bolt stop, in particular a structurally simple and functionally reliable locking device.

Some examples disclosed herein include a bolt stop for an automatic firearm comprising a bolt stop lever movable between a release position and a catch position and a locking device movable between a standby position and a locking position for selectively securing the bolt stop lever in the release position, wherein the locking device is disengaged with the bolt stop lever when in the standby position, and is engaged with the bolt stop lever when in the locking position, the locking device deactivated in the locking position. Such examples create an alternative deactivation of the bolt stop using a structurally simple and functionally reliable locking device.

In the examples disclosed herein, when the locking device is in a standby position, the locking device is disengaged from the bolt stop lever, and engages with the bolt stop lever when it is in the locked position, thereby deactivating the bolt stop lever.

In the examples disclosed herein, the firearm grip stock for an automatic firearm advantageously includes a grip stock that has a bolt stop including the features disclosed herein.

In the examples disclosed herein, the firearm receiver of an automatic firearm advantageously includes a bolt stop including the features disclosed herein.

In the examples disclosed herein, the bolt stop can be intended for a wide variety of automatic firearms, e.g. a machine gun, a sniper rifle, an assault rifle or an automatic pistol. When the firearm is a pistol, the bolt stop may be referred to as a slide stop.

The bolt stop can be deactivated via the locking device in some examples disclosed herein, i.e. the bolt stop is locked in the release position, and cannot be brought into the catching/retaining position, or bolt catching position. In particular, when firing a weapon, it is ensured in this manner that the bolt is always located in the forward position after firing a final round from the magazine, regardless of whether single rounds are fired or the weapon is used for continuous firing, in which the ejection window, which can be located on the left or right side of a weapon, is closed.

A weapon receiver, in some examples disclosed herein, includes a weapon receiver made of a single piece or multiple components, which can be composed, for example, of an upper receiver part and a lower receiver part, or grip stock. The bolt stop is provided there at an appropriate position.

In some examples disclosed herein, the lower receiver part, or grip stock, can be in the form of a grip stock module, a grip stock module with a magazine well for receiving a magazine, a grip stock module with a receiver for a trigger mechanism, a grip stock module with a magazine well and a receiver for a trigger mechanism, a grip stock module with a receiver for a trigger mechanism and a butt, or a grip stock module with a magazine well, a receiver for a trigger mechanism, and a butt.

The locking device of the examples disclosed herein has a simple structure and is functionally reliable and thus increases the reliability of a bolt stop, and a firearm equipped therewith.

In some examples disclosed herein, the bolt stop and locking device can be inexpensively produced using known metal casting methods or metal powder injection molding methods, so-called Metal Injection Molding (MEM) methods, or via typical sintering processes, for example.

In some examples disclosed herein, the bolt stop enables a blocking of the bolt stop lever in order to deactivate the bolt catching function. It is advantageously independent of the trigger mechanism, such that the risk of an operating error when actuating the trigger mechanism is reduced.

In some examples disclosed herein, the locking device includes a locking element, which is guided longitudinally in the receiver or grip stock, in particular in and counter to the direction of firing. The locking element can be in the form of a locking bolt in a simple design, for example, which is guided in a guide in the side wall of the receiver or grip stock.

In some examples disclosed herein, the locking element is placed in or on the receiver or grip stock such that it is flush therewith. For this purpose, it can be in the form of a flat locking bolt in particular, in order to prevent an unintended deactivation of the bolt stop lever.

The locking device of the examples disclosed herein can include a locking element that can pivot inside the grip stock or receiver.

In some examples disclosed herein, the locking device includes a locking element that can bolt inside the grip stock or receiver, in particular in, and counter to, the direction of firing.

The locking element is advantageously located in the interior of the grip stock or receiver for deactivation purposes in order to prevent an unintended operation thereof.

The locking element in some examples disclosed herein can be secured in the standby position and in the locking position in or on the grip stock or in or on the receiver.

In some examples disclosed herein, the locking element of the bolt stop can be retained in place via a spring-loaded retaining element.

The spring and the retaining element can be advantageously configured with simple technical means such that an unintended movement of the locking element by an acceleration in the firearm, for example, is prevented.

The locking element of the bolt stop preferably encompasses at least a segment of the bolt stop lever when the locking element is in the locked position.

As a result, the bolt stop lever can be secured in place with structurally simple means, basically via a complementary surface to a section of the bolt stop lever.

In some examples disclosed herein, the locking element of the bolt stop has a non-slip surface.

This measure also ensures an actuation of the locking element with structurally simple means under adverse conditions or when it is dirty.

In some examples disclosed herein, the locking element of the bolt stop is guided inside the grip stock or receiver on an axle.

It is also possible to subsequently retrofit a bolt stop with a locking element, or to provide such from the start, with technically simple means. The locking element can be supported on a pin, for example, in a simple design, which is inserted in the grip stock or receiver in a direction transverse to the direction of firing.

The advantage of the internal locking element is that the internal locking element is located inside the grip stock, such that an unintentional operation thereof is prevented.

In some examples disclosed herein, the locking element is in the form of a form spring, which has at least one elastic segment.

The form spring can be configured, or provided with a corresponding elasticity, such that an unintentional or accidental movement of the locking element by a shooter, and particularly by an acceleration in the firearm when firing the weapon, is prevented.

In some examples disclosed herein, the bolt stop lever in the bolt stop has a recess in which the locking element engages when in its locking position.

In some examples disclosed herein, the grip stock has at least one guide section in a side of the grip stock that guides the locking element.

In some examples disclosed herein, the grip stock comprises at least one recess in the side facing the magazine well, which passes through the locking element when the locking element is in the locking position.

In some examples disclosed herein, the grip stock preferably has at least one recess for receiving and guiding the latching element.

In some examples disclosed herein, the construction and function of the bolt stop with a locking device shall first be explained on the basis of a first example shown in FIGS. 1 to 7, and then based on a second example shown in FIGS. 8 to 12.

The invention claimed is:

1. A bolt stop for an automatic firearm, the bolt stop comprising:

a bolt stop lever movable between a bolt release position and a bolt catch position; and a locking device movable between a standby position and a locking position, the locking device in the standby position disengaged from the bolt stop lever such that the bolt stop lever is selectively enabled to move from the bolt release position to the bolt catch position and from the bolt catch position to the bolt release position, the locking device in the locking position engaged with the bolt stop lever such that the bolt stop lever is deactivated and secured in the bolt release position, the locking device including a locking element adapted to be held in place by insertion of a spring-loaded retaining element into the locking element when the locking device is in the standby position and in the locking position.

2. The bolt stop according to claim 1, wherein the locking element can be displaced longitudinally counter to a direction of firing.

3. The bolt stop according to claim 2, wherein the bolt stop lever includes a recess with which the locking element engages when the locking device is in the locking position.

4. The bolt stop according to claim 1, wherein the locking element can be displaced longitudinally in a grip stock or a receiver in and counter to a direction of firing.

5. The bolt stop according to claim 4, wherein the locking element is flush with the receiver or the grip stock.

6. The bolt stop according to claim 5, wherein the locking element is adapted to be secured in or on the grip stock or in or on the receiver when the locking device is in the standby position and in the locking position.

7. The bolt stop according to claim 5, wherein the locking element is supported on an axle inside the grip stock or the receiver.

8. The bolt stop according claim 7, wherein the locking element includes a form spring having at least one elastic segment.

9. The bolt stop according to claim 1, wherein the locking element encompasses at least a portion of the bolt stop lever when the locking device is in the locking position.

10. The bolt stop according to claim 1, wherein the locking element includes a non-slip surface.

11. The bolt stop according to claim 1, wherein the spring-loaded retaining element is in a first recess of the locking element when the locking device is in the standby position, and the spring-loaded retaining element is in a second recess of the locking element when the locking device is in the locking position.

12. The bolt stop according to claim 1, wherein the spring-loaded retaining element moves in a transverse direction relative to the locking element.

13. A firearm grip stock for an automatic firearm, the firearm grip stock comprising:

a bolt stop lever movable between a bolt release position and a bolt catch position; and a locking device movable between a standby position and a locking position, the locking device in the standby position disengaged from the bolt stop lever such that the bolt stop lever is selectively enabled to move from the bolt release position to the bolt catch position and from the bolt catch position to the bolt release position, the locking device in the locking position engaged with the bolt stop lever such that the bolt stop lever is deactivated and secured in the bolt release position, the locking device including a locking element adapted to be held in place by insertion of a retaining element into the locking element when the locking device is in the standby position and in the locking position.

14. The firearm grip stock according to claim 13, further including at least one guide segment for guiding the locking element in walls of the firearm grip stock.

15. The firearm grip stock according to claim 13, wherein the bolt stop lever includes a recess with which the locking element engages when the locking device is in the locking position.

16. The firearm grip stock according to claim 13, further including at least one recess in a wall of the firearm grip stock facing a magazine well, which passes through the locking element when the locking device is in the locking position.

17. The firearm grip stock according to claim 13, further including at least one recess for receiving and guiding the retaining element.

18. A firearm receiver for an automatic firearm, the firearm receiver comprising:

a bolt stop lever movable between a bolt release position and a bolt catch position; and a locking device movable between a standby position and a locking position, the locking device in the standby position disengaged from the bolt stop lever such that the bolt stop lever is selectively enabled to move from the bolt release position to the bolt catch position and from the bolt catch position to the bolt release position, the locking device in the locking position engaged with the bolt stop lever such that the bolt stop lever is deactivated and secured in the bolt release position, the locking device including a locking element adapted to be held in place by insertion of a spring-loaded retaining element into the locking element when the locking device is in the standby position and in the locking position.

* * * * *